US009637925B2

(12) United States Patent
Francies, III

(10) Patent No.: US 9,637,925 B2
(45) Date of Patent: May 2, 2017

(54) STRAND CHAIR FOR SUPPORTING PRESTRESSING CABLE

(71) Applicant: Sidney E. Francies, III, Lithia, FL (US)

(72) Inventor: Sidney E. Francies, III, Lithia, FL (US)

(73) Assignee: A.L. Patterson, Inc., Fairless Hills, PA (US)

( * ) Notice: Subject to any disclaimer, the term of this patent is extended or adjusted under 35 U.S.C. 154(b) by 0 days.

(21) Appl. No.: 14/931,402

(22) Filed: Nov. 3, 2015

(65) Prior Publication Data

US 2016/0123012 A1 May 5, 2016

Related U.S. Application Data

(60) Provisional application No. 62/074,976, filed on Nov. 4, 2014.

(51) Int. Cl.

| | |
|---|---|
| ***F16L 3/22*** | (2006.01) |
| ***E04C 5/16*** | (2006.01) |
| *E04C 5/08* | (2006.01) |

(52) U.S. Cl.

CPC ..... *E04C 5/168* (2013.01); *E04C 5/08* (2013.01)

(58) Field of Classification Search

USPC ..... 248/68.1

See application file for complete search history.

(56) References Cited

U.S. PATENT DOCUMENTS

| | | | | | |
|---|---|---|---|---|---|
| 3,673,753 | A * | 7/1972 | Anderson | E04C 5/168 | 52/649.8 |
| 4,306,697 | A * | 12/1981 | Mathews | F16L 3/222 | 248/68.1 |
| 4,644,727 | A * | 2/1987 | Hanson | E04C 5/08 | 52/678 |
| 4,795,856 | A * | 1/1989 | Farmer | F16L 3/223 | 174/40 R |
| 7,322,158 | B1 * | 1/2008 | Sorkin | E04C 5/167 | 52/649.8 |
| 7,497,059 | B2 * | 3/2009 | Bennett | E04C 5/08 | 52/649.8 |
| 8,882,053 | B2 * | 11/2014 | Chirpich | F16L 3/1075 | 211/70.1 |
| 8,985,532 | B2 * | 3/2015 | Chirpich | F16L 3/221 | 248/49 |
| 9,115,492 | B2 * | 8/2015 | Parham | E04C 5/20 | |
| 2004/0232286 | A1 * | 11/2004 | Newkirk | A61G 7/0503 | 248/68.1 |
| 2011/0290954 | A1 * | 12/2011 | Smallhorn | H02G 3/32 | 248/68.1 |
| 2013/0092801 | A1 * | 4/2013 | Lares | H02G 3/30 | 248/68.1 |
| 2014/0034356 | A1 * | 2/2014 | McCoy | F16L 3/02 | 174/135 |

* cited by examiner

*Primary Examiner* — Monica Millner
(74) *Attorney, Agent, or Firm* — McGarry Bair PC

(57) ABSTRACT

A strand chair for supporting a prestressing cable in a cement cast. The strand chair contains a lower cup for receipt of a lower prestressing cable as well as an upper cup for supporting an upper prestressing cable. The strand chair utilized the pressures of the stressed cables to support and position a reveal which runs along the casting bed. Furthermore, the strand chair supports the placement of rebar utilized in the cement casting.

16 Claims, 8 Drawing Sheets

STRAND CHAIR FOR SUPPORTING PRESTRESSING CABLE

CROSS-REFERENCE TO RELATED APPLICATIONS

The present application claims the benefit of U.S. Provisional Patent Application No. 62/074,976, filed Nov. 4, 2014, which is incorporated by reference herein in its entirety.

BACKGROUND OF THE INVENTION

Field of the Invention

The invention relates to strand chair supports for prestressing cables for a cement plank cast.

Description of the Related Art

Concrete panels are cast in long lengths on a casting bed. Prestressing or prestressed cables are run along and within the casting bed in order to support the cast concrete panels. The prestressing cables are put under high tension prior to casting, yet tend to droop, sag, or move from an initial position during concrete casting.

Plastic clips or chairs are generally used to support the prestressing cables and any rebar that may be run through the casting bed. Current clips or chairs utilized in the industry are cumbersome, time consuming, or expensive to install. Some chairs or clips fail to appropriately support the prestressing cables or rebar due to the weight of the units being supported or the tension being applied to the cables. The further weight and inertia of concrete pouring into the cast tends to move or improperly orient the prestressing cables.

After appropriately supporting the prestressing cables and rebar, concrete is poured into the casting bed. After a curing process, the concrete is cut for particular use.

SUMMARY OF THE INVENTION

In one aspect, the invention relates to a strand chair for supporting prestressed cables comprising an elongated body having a longitudinal axis, a lower portion, and an upper portion. The strand chair further comprises an upper cup in the upper portion sized to receive a first prestressed cable and a lower cup in the lower portion sized to receive a second prestressed cable and has at least two legs at the lower portion. The upper cup is open axially along the longitudinal axis and the lower cup is open normal to the longitudinal axis.

In another aspect, a method of supporting prestressed cable in a cement casting having a casting pallet. The method comprises providing a strand chair, having an elongated body with a longitudinal axis, an upper cup sized to receive an upper cable, a lower cup sized to receive a lower cable, at least two legs, and a v-notch between the two legs wherein the upper cup is open axially along the longitudinal axis and the lower cup is open normal to the longitudinal axis. The method further comprises tensioning the upper and lower cables in a cement casting, positioning the strand chair with the upper cable received in the upper cup, and rotating the strand chair until the lower cable is received in the lower cup with the at least two legs resting on the cement casing.

DESCRIPTION OF THE PREFERRED EMBODIMENT

As used herein, the term 'prestressing' or 'prestressed' when used in combination with cable refers to cable which can be or has been tensioned by a force such that the cable becomes taut. It should be appreciated that the terms 'prestressing' and 'prestressed' can be used interchangeably and should not be understood as limiting the invention to either of a cable which has been tensioned or will be tensioned. It is further contemplated that the invention can be utilized with a non-tensioned cable, which is capable of tensioning.

Figure 1:
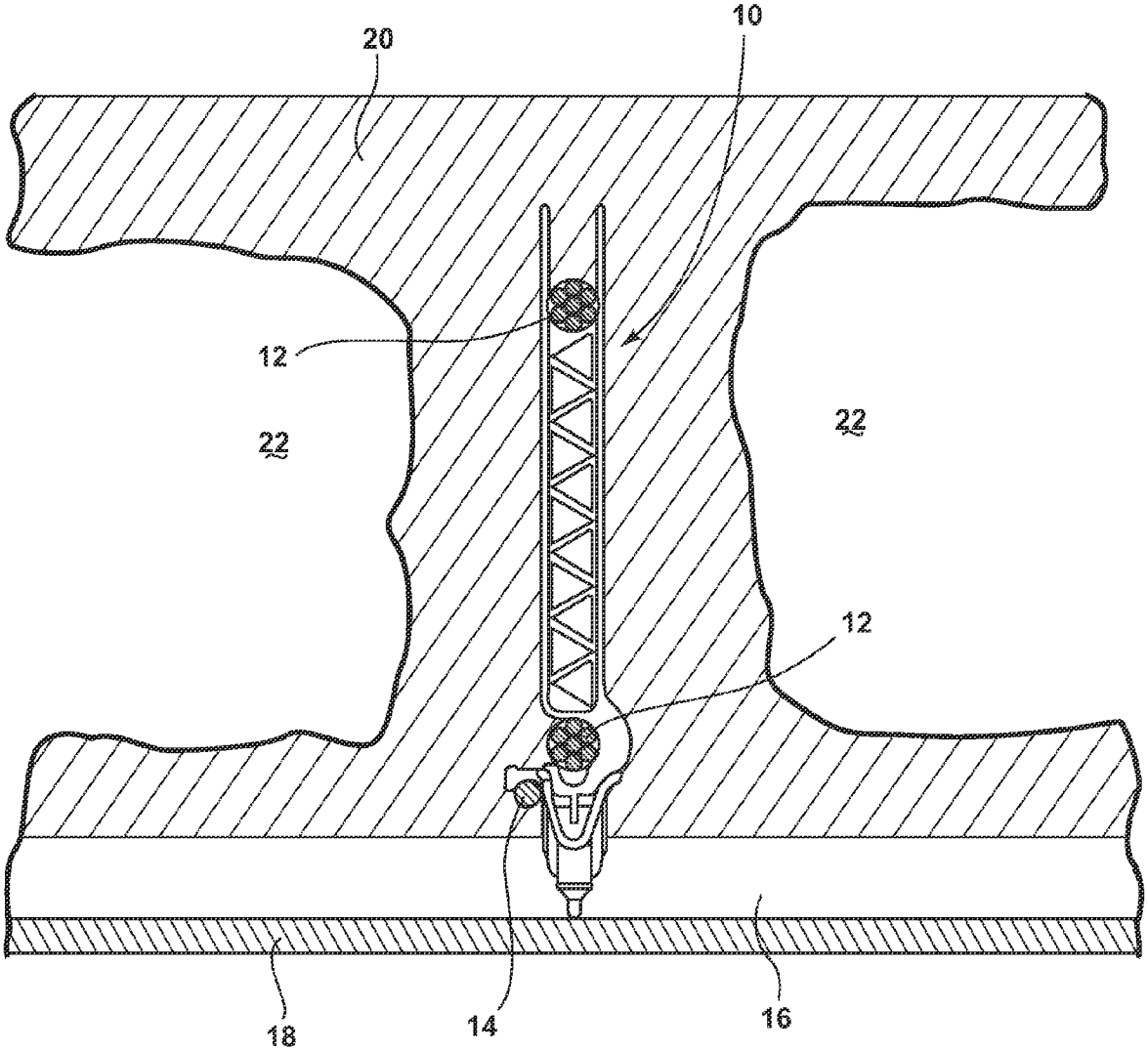
FIG. 1 is a front view of a strand chair in a cured concrete cast.

Turning now to the drawings and in particular to FIG. 1, a strand chair 10 couples to a set of two prestressed cables 12 and rebar 14. The strand chair 10 is disposed over a reveal 16 running along a casting pallet 18 at the bottom of a concrete cast 20. The reveal 16 can run laterally relative to the direction of the prestressing cables 12 and the rebar 14 or can run longitudinally. The concrete cast 20 can comprise one or more voids 22 created in the cement cast 20 during cementing operations. The strand chair 10 uses the high tension of the prestressing cables to hold the reveal 16 in place along the casting pallet 18 during cementing operations. The strand chair 10 is preferably made of high strength polymers or plastics, which are strong enough to support the weight and tension of prestressed cables 12 during cementing operations, while adding minimal weight to the cement cast. Alternatively, the strand chair 10 can be made of other materials, including but not limited to steel, cast iron, aluminum, or any other suitable material.

Figure 2:
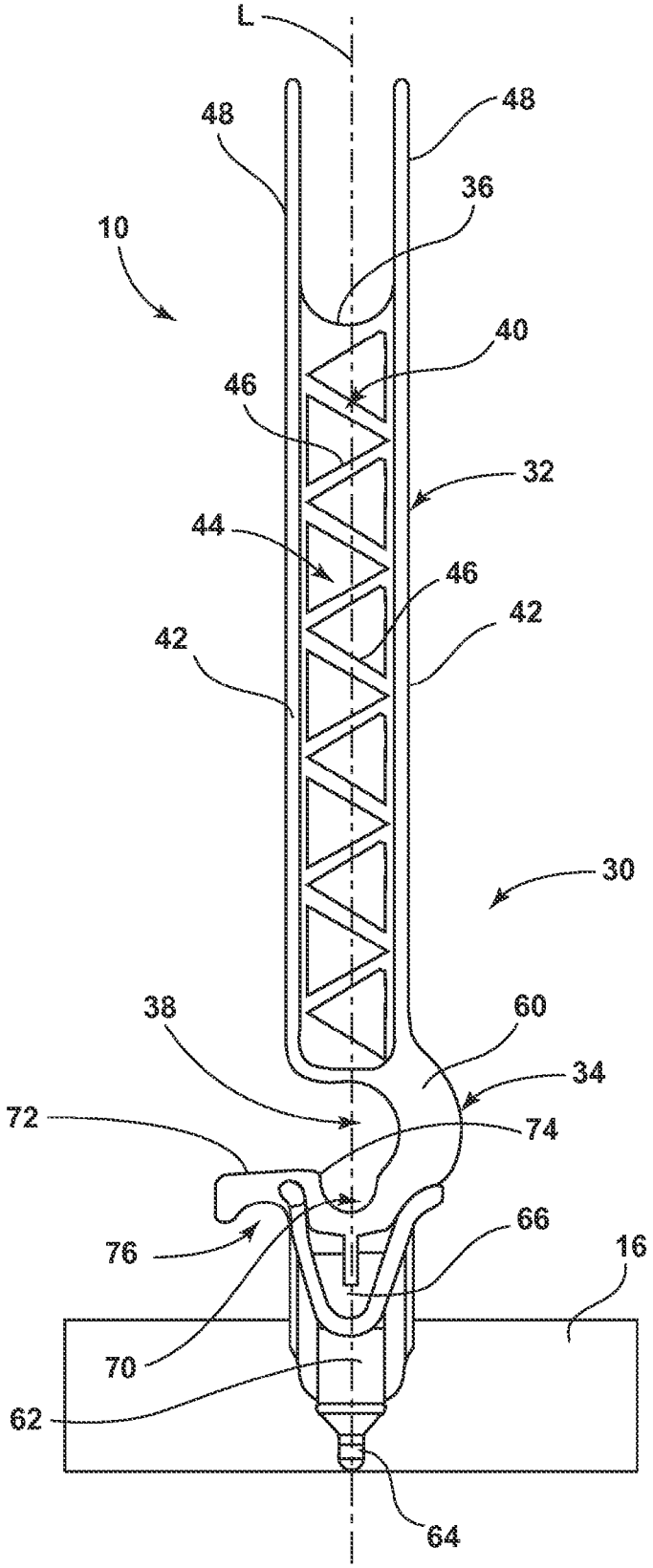
FIG. 2 is a front view of the strand chair of FIG. 1.

FIG. 2 shows a front view of the strand chair 10 isolated from the cementing environment. The strand chair 10 comprises a body having an upper portion 32 and a lower portion 34 disposed opposite of the upper portion 32. The body 30 defines a longitudinal axis L along the length of the body 30. The upper portion 32 comprises an upper cup 36 and the lower portion 34 comprises a lower cup 38, both cups 36, 38 being sized to receive a prestressed cable 12. The upper cup 36 is open axially along the longitudinal axis L of the body 30, while the lower cup 38 is open normal to the longitudinal axis L of the body 30.

The upper portion 32 further comprises a matrix structure 40 disposed between the side members 42. The side members 42 extend beyond the upper cup 36, defining cup walls 48 preventing lateral movement of a prestressed cable inserted into the upper cup 36. The matrix structure 40 comprises a plurality of triangular recesses 44 defined between a plurality of angled ribs 46. It should be appreciated that the triangular recesses defining the matrix structure 40 are exemplary, and that square or circular recesses as defined by the ribs, or any other such geometry can define the matrix structure 40. Furthermore, the matrix structure 40 can be a latticed structure or otherwise, such that structural support is defined between the side members 42 while optimizing overall weight of the upper portion 32.

A support member 60 defines a junction between the upper portion 32 and the lower portion 34, and is shaped to define the hollow opening of the lower cup 38. The support member 60, opposite of the upper portion 32, coupled to a set of legs 62. The legs 62 extend parallel to the longitudinal direction of an inserted prestressed cable 12 and perpendicular to the longitudinal direction of the reveal 14. Each leg 62 comprises a foot 64 for resting on the casting pallet or other concrete casting surface. The foot 64 can be rubber or plastic to resist sliding movement of the strand chair 10 during cementing operations. A reveal support 66 is disposed between the legs 62, adjacent to the reveal 16 which is disposed between the legs 62.

The support member 60 can be further shaped to receive and retain the prestressed cable. The lower cup 38 can further comprise a space 70. The space 70 minimizes overall contact surface with the prestressed cable and can provide a corner 74 to grip the prestressed cable upon insertion. Adjacent the space 70 is a guide 72. The guide 72 defines a surface for resting and guiding the prestressed cable into the lower cup 38. The guide 72 can further be shaped to support a stand-alone prestressed cable 12. The size and shape of the guide 72 can be altered to give more or less support to a stand-alone prestressed cable as may be desired. A rebar cup 76 is disposed in an underside of the guide 72 for supporting rebar adjacent to the strand chair 10.

Figure 3:
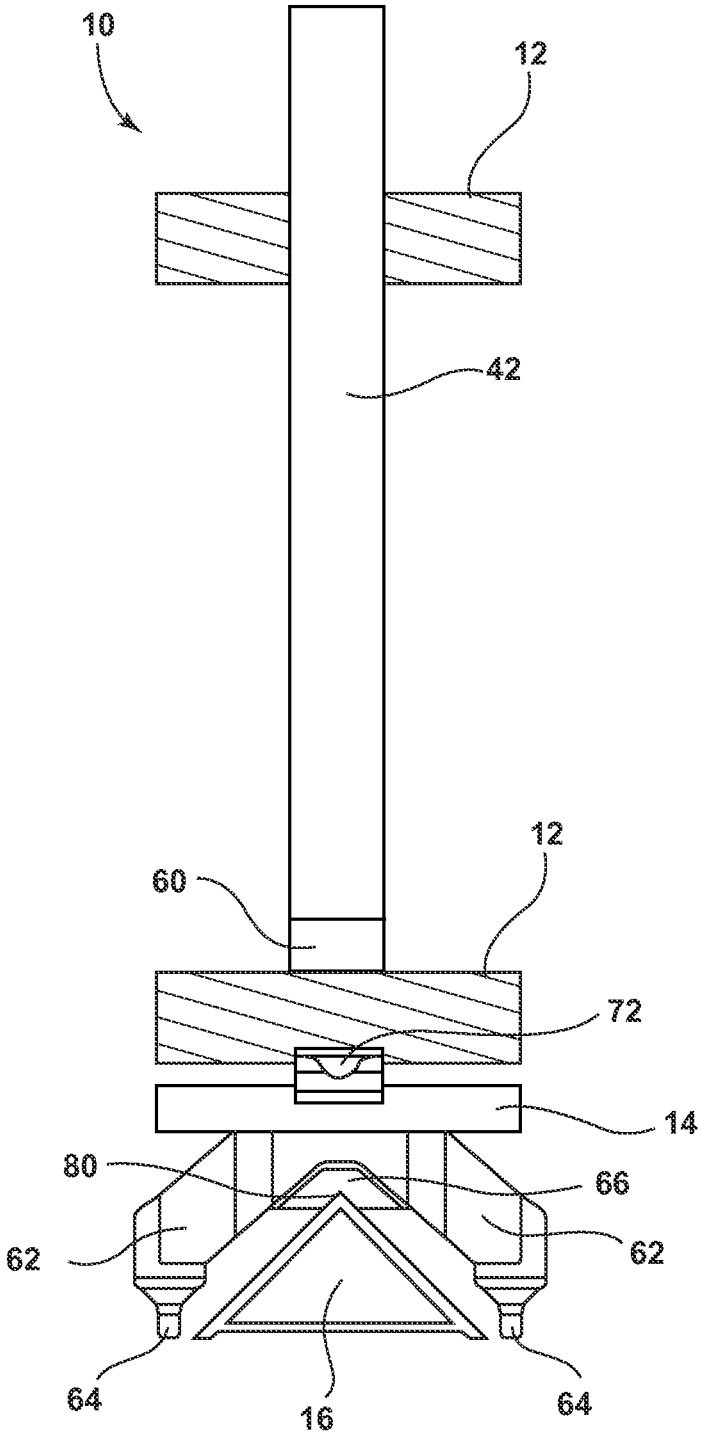
FIG. 3 is a side view of the strand chair of FIGS. 1 and 2 supporting a prestressing cable and rebar.

Turning to FIG. 3, a side view of the strand chair 10 best illustrates the width of the portions 32, 34 as well as the reveal support 66, having prestressed cables 12 disposed within the cups 36, 38. The upper portion 32 and lower portion 34 are sized to support the prestressed cables 12 running through the cups 36, 38. The reveal support 66 further comprises a v-notch 80. The v-notch 80 can comprise a v-shaped groove in the reveal support 66 for resting on the reveal 16. Alternatively, the v-notch 80 can snap, lock, weld, or otherwise connect to the reveal 16. The v-notch is adapted to position the strand chair 10 such that the legs 62 and feet 64 are spaced from the reveal 16, preventing misalignment, tipping, or movement of the strand chair 10 or reveal 16 relative to one another during cementing operations.

Figure 4:
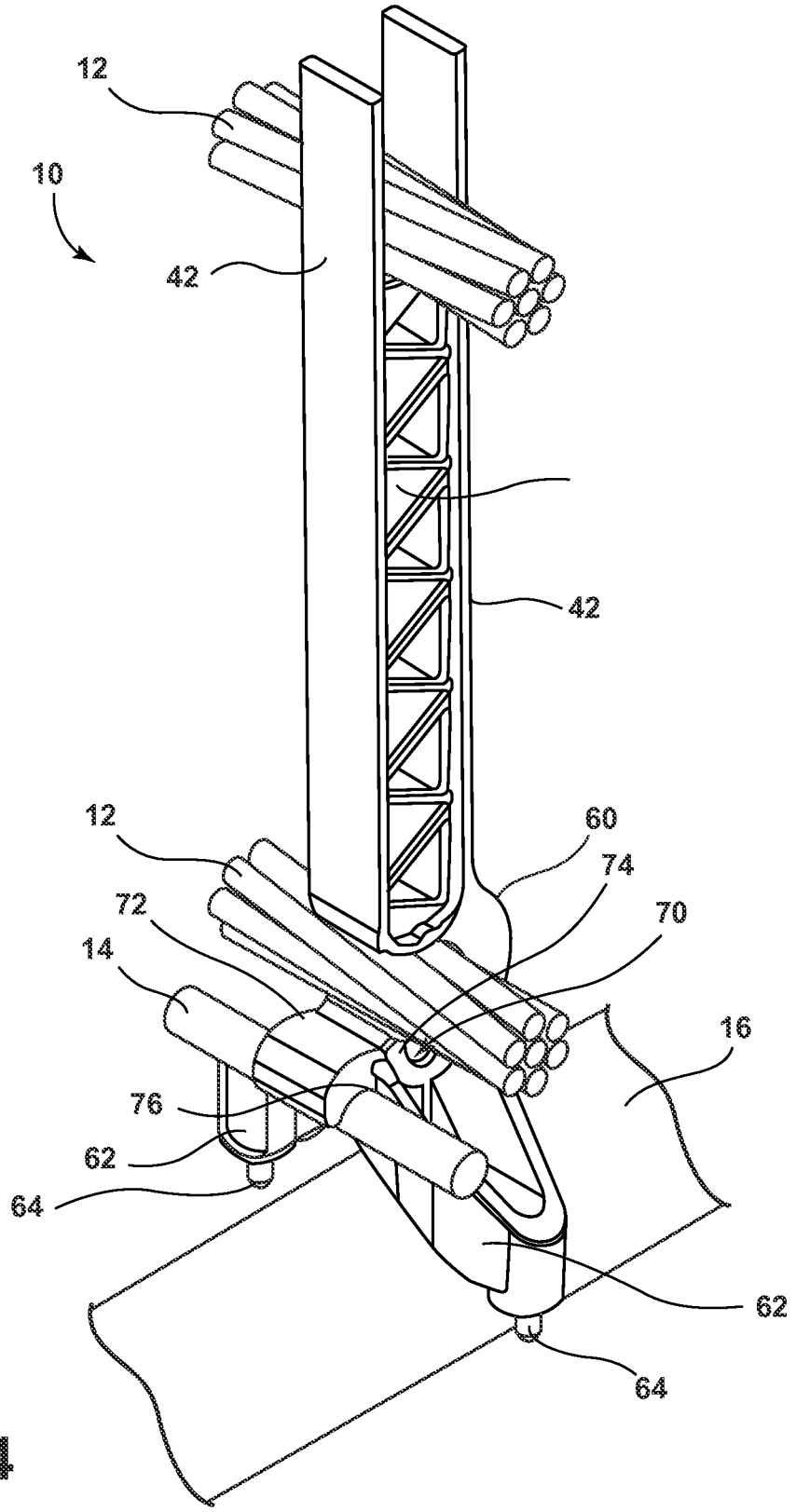
FIG. 4 is a front perspective view of the strand chair of FIGS. 1-3 supporting a prestressing cable and rebar.

Turning now to FIG. 4, a perspective view illustrates the strand chair 10 having a corner 74 extending above the guide 72. The extended corner 74 provides for greater gripping of the inserted prestressed cable 12. Additionally, the guide 72 has an arcuate surface as compared to a flat surface of FIG. 2. The arcuate surface provides a curved surface for guiding the prestressed cable 12 into the lower cup 38 during cable insertion. Furthermore, the arcuate guide 72 can curl around the rebar cup 76 for holding the inserted rebar 14 as compared to simply aligning the rebar 14.

Figure 5:
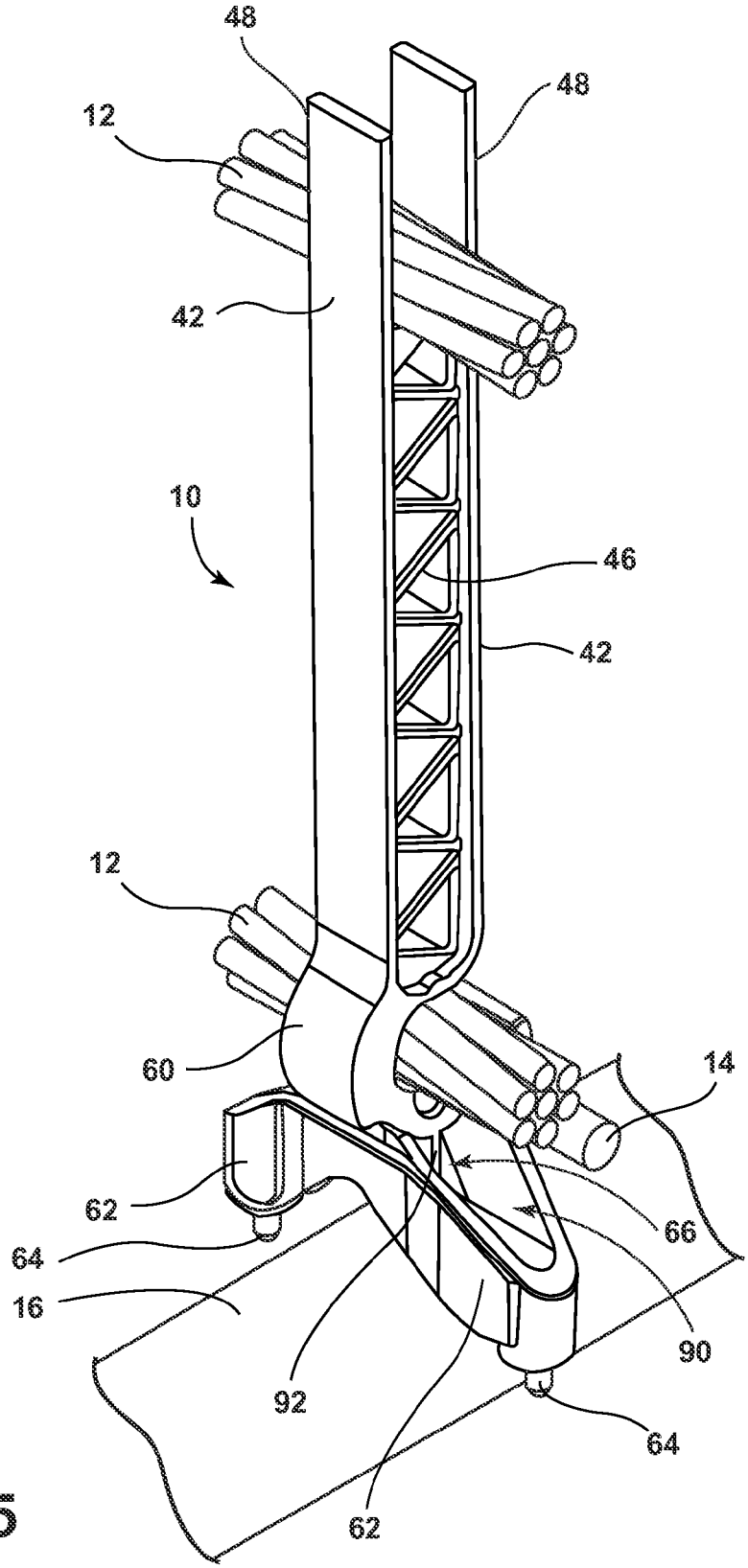
FIG. 5 is a rear perspective view opposite the strand chair of FIG. 3.

FIG. 5 is similar to that of FIG. 4, showing the reverse perspective side of the strand chair 10. FIG. 5 additionally shows a gap 90 defined between the sides of the legs 62. An interior wall 92 extends from below the lower cup 38 and couples to the reveal support 66. Thus, the body 30 is supported by the reveal 16 through the interior wall 92 and is supported by the legs 62 and the feet 64 on the casting pallet or bottom surface.

Figure 6:
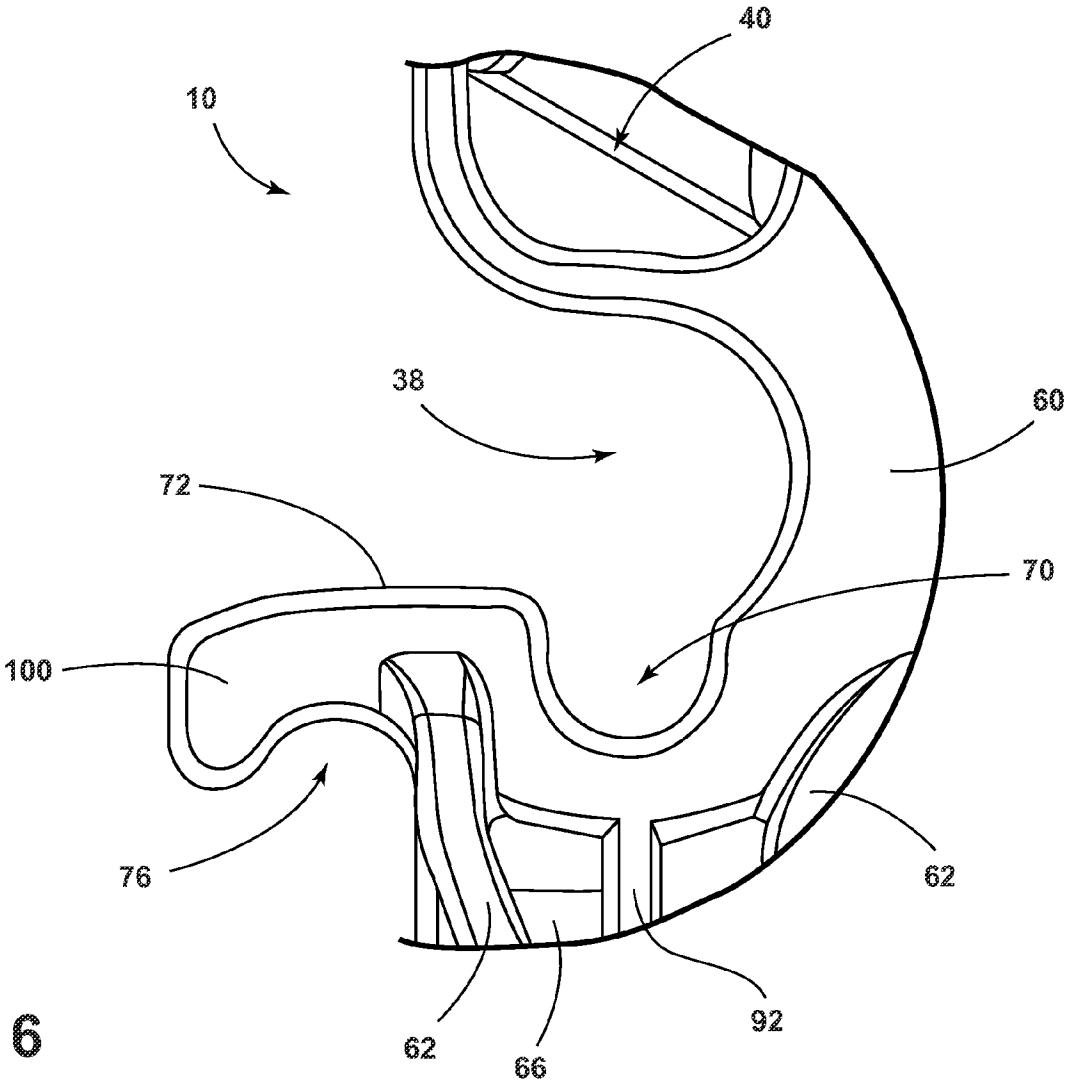
FIG. 6 is a close-up view of a cup of the strand chair.

FIG. 6 shows close-up view of the lower cup 38. The lower cup 38 is surrounded by the support member 60, and further defined by the space 22 and the guide 72. The guide 72 has an extension 100 for defining the length of the guide 72 and can further extend downward to at least partially surround the rebar cup 76.

It should be understood that while the embodiment of the strand chair as shown is described as having two legs 62, the strand chair can comprise at least two legs 62. For example, the strand chair can have four legs with two legs disposed on either side of the reveal 14. Furthermore, the strand chair can have four legs comprising two sets of two integral legs on either side of the reveal 14. It should be appreciated that a four-leg embodiment will increase the stability of the strand chair 10, such that tensioning of the cables, installation of additional strand chairs, or cementing operations does not subject the installed strand chairs to tipping.

Figure 7:
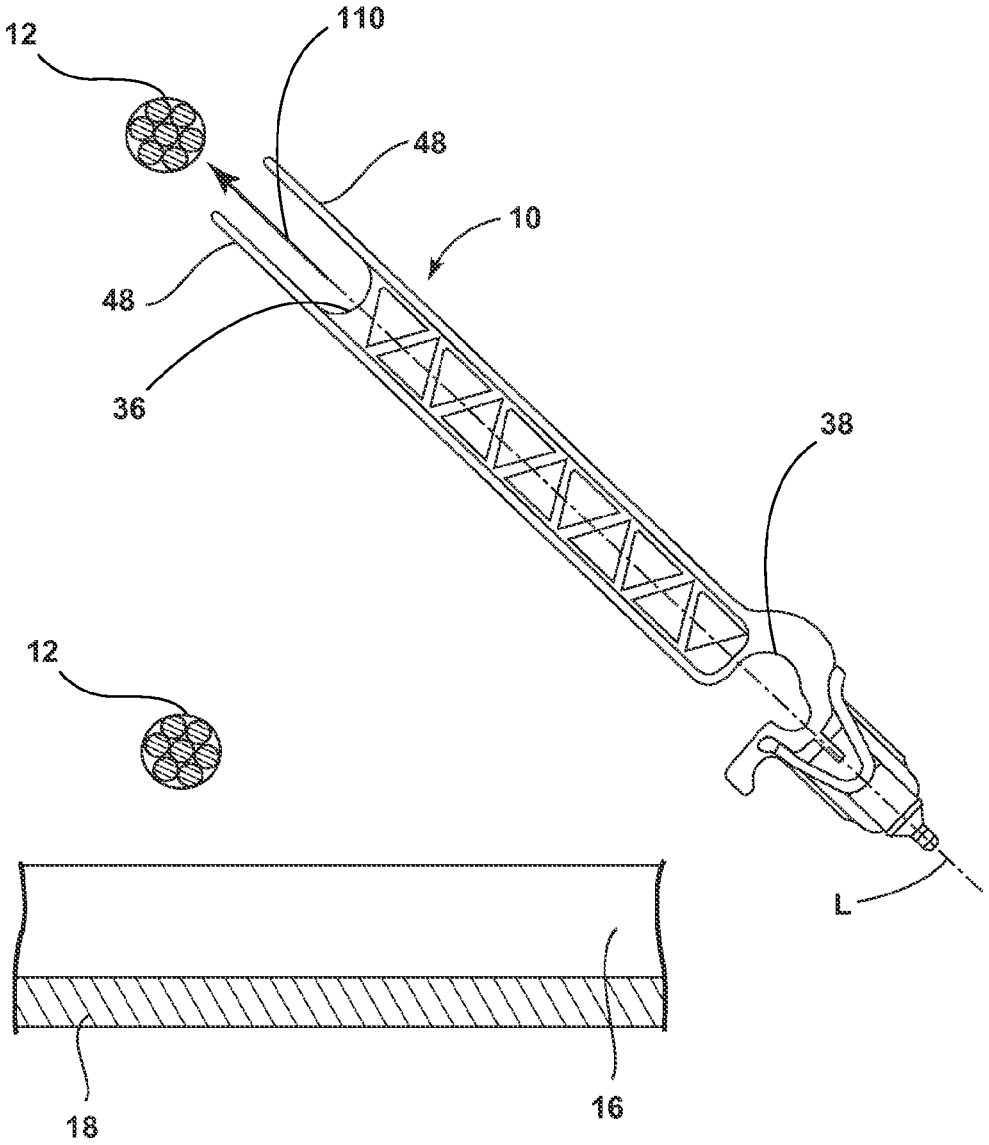
FIG. 7 is a view illustrating a step of a method of installing the strand chair to an upper prestressing cable.

Now turning to FIGS. 7 and 8, a method of installing the strand chair 10 will be described. Beginning with FIG. 7, a strand chair 10 is provided and can be the strand chair 10 of FIGS. 1-6, having the upper cup 36 being open axially along the longitudinal axis L of the strand chair 10 and the lower cup 38 open normal to the longitudinal axis L. The cables are tensioned to comprise prestressed cables 12. The cup walls 48 are positioned adjacent to the upper prestressed cable 12 such that the strand chair 10 can be moved to insert the prestressed cable 12 into the upper cup 36 as shown by arrow 110. The strand chair 10 is slid until the strand chair is positioned with the upper prestressed cable 12 positioned within and in contact with the upper cup 36.

Figure 8:
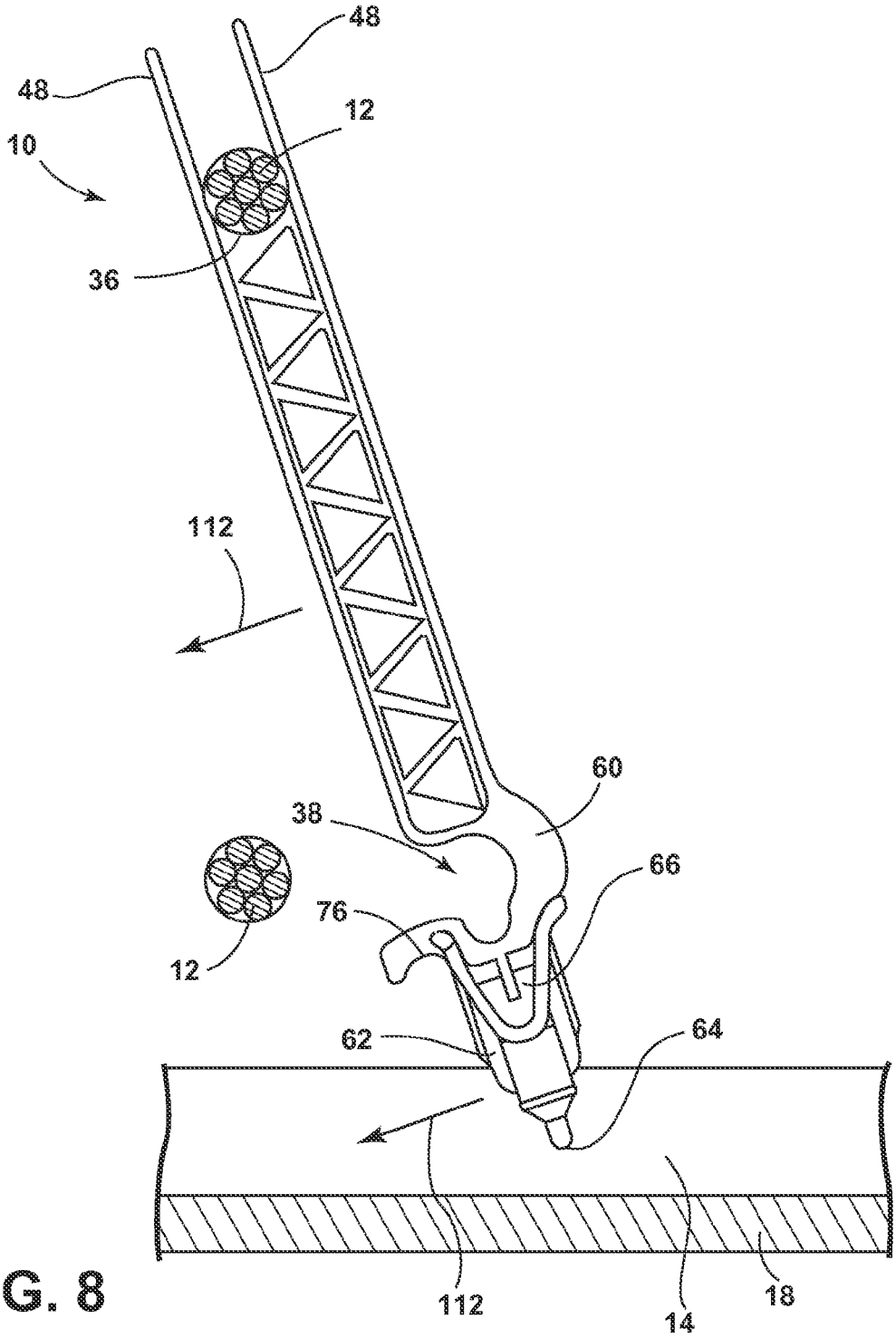
FIG. 8 is a view illustrating a step of a method of installing the strand chair to a lower prestressing cable.

Turning to FIG. 8, the strand chair 10 is rotated about the upper prestressed cable 12 disposed within the upper cup 36 as illustrated by arrows 112. The strand chair 10 is rotated until the lower prestressed cable 12 is inserted into the lower cup 38. The feet 64 can rest on the casting pallet 18 and the reveal support 66 can be aligned such that the reveal 14 is position within the v-notch 80 of the reveal support 66, spacing the legs 62 between the reveal 14.

The reveal 14 can be laid on the casting pallet 18 prior to positioning the strand chair 10 with the upper prestressed cable 12 in the upper cup 36. The method can further comprise receiving rebar in the rebar cup 76 positioned parallel to the prestressed cables 12. Furthermore, the method can include repeating the method for multiple strand chairs 10 disposed within a cement casting.

It should be appreciated that the strand chair as described herein provides for simplified installation of chair support for a plurality of prestressed cables in a concrete cast. The axially opened orientation of the upper cup and the perpendicular opening of the lower cup further provides an easy method for installing the strand chair with cable being previously tensioned, without the need to attempt to moved, pull, or adjust the prestressed cables prior to installation. Additionally, the strand chair provides the v-notch for positioning the strand chair over a reveal as well as securing the reveal relative to the strand chair and the prestressed cables, minimizing the incidence of movement of the reveal or strand chairs during cementing operations.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

What is claimed is:

1. A strand chair for supporting prestressed cables comprising:

an elongated body a having longitudinal axis and a lower portion and an upper portion;

an upper cup on the longitudinal axis in the upper portion sized to receive a first prestressed cable;

a lower cup on the longitudinal axis in the lower portion sized to receive a second prestressed cable; and at least two legs at the lower portion;

wherein the upper cup is open axially along the longitudinal axis and the lower cup is open normal to the longitudinal axis.

2. The strand chair of claim 1 further comprising a v-notch between the at least two legs.

3. The strand chair of claim 2 further wherein the v-notch is configured to mount in a reveal of a concrete casting and with the reveal disposed between the at least two legs.

4. The strand chair of claim 1 further comprising a matrix structure between the lower and upper cups.

5. The strand chair of claim 1 wherein the at least two legs comprises four legs.

6. The strand chair of claim 5 wherein the four legs comprises two sets of two integrally connected legs disposed on either side of the strand chair.

7. The strand chair of claim 1 further comprising a rebar cup positioned laterally from the lower cup.

8. The strand chair of claim 1 wherein the lower cup includes a lower void.

9. The strand chair of claim 1 wherein the strand chair comprises high strength polymers or plastics.

10. A method of supporting prestressed cables in a cement casting having a casting pallet, the method comprising:

providing a strand chair, having an elongated body with a longitudinal axis, an upper cup sized to receive an upper cable, a lower cup sized to receive a lower cable, at least two legs, and a v-notch between the two legs wherein the upper cup is open axially along the longitudinal axis and the lower cup is open normal to the longitudinal axis tensioning upper and lower cables in a cement casting;

positioning the strand chair with the upper cable received in the upper cup; and rotating the strand chair until the lower cable is received in the lower cup with the at least two legs resting on the cement casing.

11. The method of claim 10 further comprising laying a reveal on the cement pallet before positioning the strand chair.

12. The method of claim 11 further comprising fitting the v-notch over the reveal.

13. The method of claim 12 further comprising aligning the strand chair over the reveal such that the at least two legs are spaced from the reveal.

14. The method of claim 10 wherein the strand chair has a rebar cup positioned laterally of the lower cup and receiving a rebar in the rebar cup.

15. The method of claim 10 further comprising positioning and rotating for multiple strand chairs.

16. The method of claim 10 further comprising adding cement to the cement casting.

* * * * *